United States Patent [19]

Ushikoshi

[11] 4,316,274

[45] Feb. 16, 1982

[54] BATTERY LIFE INDICATION METHOD FOR AN ELECTRONIC TIMEPIECE

[75] Inventor: Kenichi Ushikoshi, Suwa, Japan

[73] Assignee: Kabushiki Kaisha Suwa Seikosha, Tokyo, Japan

[21] Appl. No.: 7,533

[22] Filed: Jan. 29, 1979

[30] Foreign Application Priority Data

Jan. 27, 1978 [JP] Japan ..... 53/8081
Jan. 27, 1978 [JP] Japan ..... 53/8082
Jan. 27, 1978 [JP] Japan ..... 53/8083

[51] Int. Cl.[3] ..... G04B 9/00

[52] U.S. Cl. ..... 368/66; 368/203; 368/204

[58] Field of Search ..... 368/66, 203, 204; 320/2, 3

[56] References Cited

U.S. PATENT DOCUMENTS 3,762,153 10/1973 Komiyama et al. ..... 368/187
3,998,043 12/1976 Tamaru et al. ..... 368/66
4,014,164 3/1977 Fujita ..... 368/66
4,028,880 6/1977 Ueda ..... 368/66

*Primary Examiner*—Ulysses Weldon
*Attorney, Agent, or Firm*—Blum, Kaplan, Friedman, Silberman and Beran

[57] ABSTRACT

The degenerating condition of the power source in an electronic timepiece, that is, a diminished battery voltage, is indicated to the user by unusual performance of the watch bands. Short periods of accelerated or decelerated hand movements alert the user to the battery condition. Persistent though intermittent unusual hand behavior distinguishes the battery life signals from malfunctions or poor timekeeping. A voltage detector circuit monitors the power source and on low voltage initiates the warning signals which are derived from the divider network of the timepiece. Mechanically resetting the hands to remove the visible effects or erratic hand movement, serves to reset the battery life detector circuits and repeat the warnings.

16 Claims, 12 Drawing Figures

FIG. 1
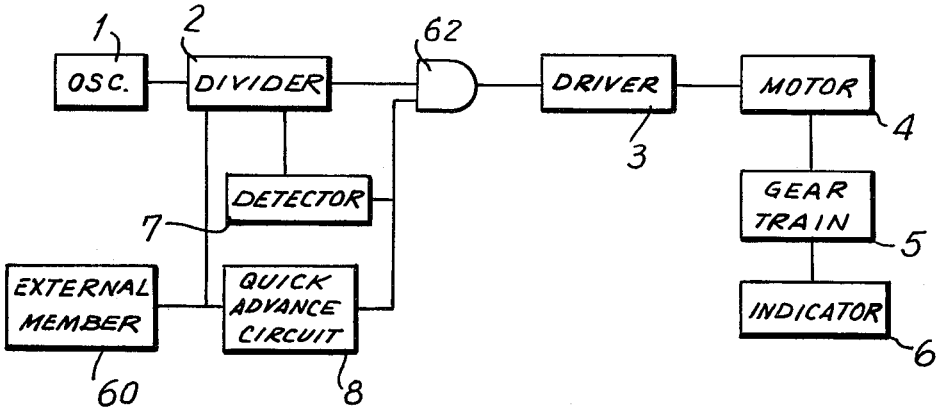
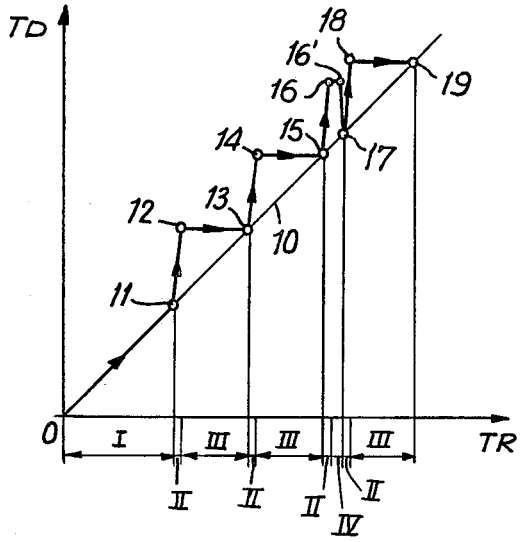
FIG. 2

BATTERY LIFE INDICATION METHOD FOR AN ELECTRONIC TIMEPIECE

BACKGROUND OF THE INVENTION

This invention relates generally to timepieces of the electronic type and more particularly to an electronic timepiece having hands and having means for indicating the condition of the internal battery by means of the hands. In a conventional analog quartz crystal timepiece of the prior art having hour, minute and second hands, the approaching termination of the battery life is displayed by detecting the battery voltage reduction and then advancing the second hand by two second sections on the face of the watch at intervals of two seconds. Normally the second hand is driven once a second over a one second section. As a result the timepiece keeps the proper time, but the second hand passes through a greater angle of rotation with each movement and at a reduced repetition rate of movement. For a two-hand timepiece, having only hour and minute hands, such as a dress watch or a ladies' watch, in the prior art, exhaustion of the battery life is indicated by means of a light emitting diode or by automatically putting the timepiece forward in its time indication on the dial, for example, by ten minutes or so. When the light emitting diode is used, there must be a limitation in current consumption so the design of the timepiece and its cost become high. Also when the timepiece is automatically put forward or back by a certain magnitude of time as seen on the dial, the timepiece may be regarded by the user as being out of order. Thus the special condition which warns the user that the battery life is near exhaustion, may be ignored.

What is needed is a battery life indication for an electronic wristwatch, which is readily identifiable to the user and which employs the hands on the face of the watch dial.

SUMMARY OF THE INVENTION

Generally speaking, in accordance with the invention, an electronic analog timepiece especially suitable for indicating the condition of the battery source by means of the hands on the dial, is provided. The degenerating condition of the power source in the electronic analog timepiece, that is a diminished battery voltage, is indicated to the user by unusual performance of the watch hands. Short periods of accelerated or decelerated hand movements alert the user to the battery condition. Persistent though intermittent unusual hand behavior distinguishes the battery life signals from malfunctions or poor timekeeping. A voltage detector circuit monitors the power source and on low voltage initiates the warning signals which are derived from the divider network of the timepiece. Mechanically resetting the hands to remove the visible effects of the radical movement, serves to reset the battery life detector circuit and repeat the warnings.

Accordingly, it is an object of this invention to provide an electronic analog timepiece which provides indication of a deteriorating condition in the internal power source.

Another object of this invention is to provide an electronic analog wristwatch which indicates a deteriorating battery condition by means of erratic accelerated movement or non-movement of the hands.

Still another object of this invention is to provide an electronic analog wristwatch which repeats warnings of a deteriorating battery condition even after the hands have been reset by the user.

Yet another object of this invention is to provide an electronic analog timepiece which warns of the deteriorating battery conditions without the use of special indicating devices such as light emitting diodes.

Still other objects and advantages of the invention will in part be obvious and will in part be apparent from the specification.

The invention accordingly comprises the several steps and the relation of one or more of such steps with respect to each of the others, and the apparatus embodying features of construction, combination of elements and arrangment of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a functional block diagram of a timepiece in accordance with this invention;

FIG. 2 is a chart of the movement of the minute hand of the timepiece of FIG. 1 in accordance with this invention;

DESCRIPTION OF THE PREFERRED EMBODIMENTS

Figure 3:
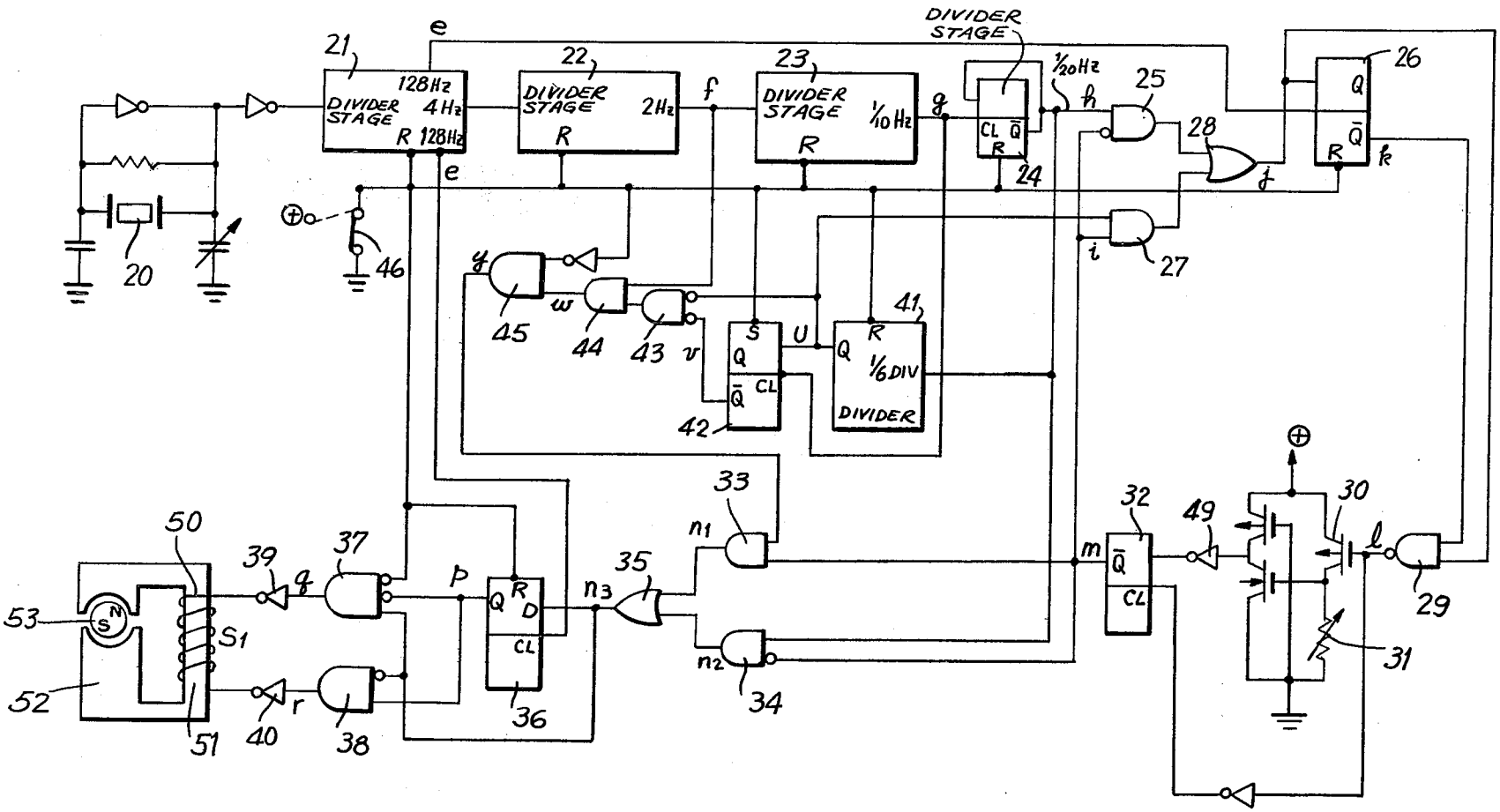
FIG. 3 is the electrical circuit for the timepiece of FIG. 1.

This invention provides the means for indicating when the battery life is about to be exhausted in a two-hand, that is hour and minute hand, timepiece. This invention is also applicable to the three-hand timepiece, however in a preferred embodiment of this invention as described hereinafter movement of the minute hand is described.

In FIG. 1, a quartz crystal vibrator or the like is oscillated as a time standard source by using an oscillation circuit 1, for instance with the frequency of 32 KHz. Well-known flipflop circuits (FF) are used as the divider network 2. These are conventional circuits and frequency divisions of one-half or one-third, one-fifth or one-sixth can easily be obtained by means of flip-flop circuits in combination. The signal from the divider network 2 is shaped in the driving circuit 3 to have a waveform suited for driving the motor 4. The well-known step motor 4 including a coil, a coil core, a stator and a rotor consisting of a permanent magnet, is conventionally used in these timepieces. The signal for driving the motor 4 is usually a signal by which the second hand is driven every second in a timepiece having three hands. However in a timepiece having only an hour hand and a minute hand, because it is not inconvenient if the minute hand is driven intermittently at intervals of several seconds to several minutes, the minute hand is driven at proper intervals of time which are determined by taking into consideration the output torque of the motor and the ratio of gears in the gear train 5. The rotational speed of the motor 4 is reduced in the gear train 5. The minute hand and the hour hand (not shown) are fixed to the minute wheel or the hour wheel in the indicator 6, all in a structure which is well known for the conventional quartz crystal timepiece.

In order to detect and display the battery life, the timepiece according to this invention is provided with a detector circuit 7 for detecting the supply voltage magnitude, and the circuit 8 which produces a signal for quickly advancing the minute hand when a battery voltage reduction is detected. The circuit 8 for quickly advancing the hand uses a timer or a counter to generate suitable pulses for application to the driver 3. A signal for quickly advancing the minute hand is also controlled by an external operational member 60, for example, a pushbutton, a crown or a winding stem. The quick advance signal and the timekeeping signal from divider 2 are applied to the driver 3 through logical network schematically represented by logic element 62 as more particularly described below.

It should be understood for purposes of this description that the term "battery life" refers to the present condition of the internal battery of the timepiece as indicated by the output voltage of the battery. The normal operating voltage is about 1.5 V for a silver battery, or the like, used in an electronic timepiece. This voltage remains relatively stable until near the end of the capacity of the battery. Then the voltage drops rapidly when the capacity of the battery is about to be exhausted. These terms are relative. Because the life of the battery as used in the electronic timepiece extends over a prolonged period of time, for example, a year, the period of time during which the battery voltage is dropping at the so-called rapid rate may extend for weeks. Therefore there is ample time for detection of lowered battery voltage, i.e., battery life, before the timpiece will actually lose its capability to keep accurate time or to operate at all. As stated above this battery life indication invention may be applied to two or three handed timepieces. However, means have been provided, and are widely used, for displaying a low voltage condition of the battery in timepieces having three hands including the second hand. Therefore the description which follows is based upon a two-handed timepiece having only the hour and minute hand. The application of this invention to three-handed timepieces will be obvious to those skilled in the art.

In FIG. 2, the visible display to indicate low battery voltage (battery life) according to this invention is described. The abscissa of the chart represents the real time TR. The ordinate of the chart represents the time displayed TD, that is the time which is indicated by the hour hand and the minute hand in the indicator portion 6 of the timepiece. When the ordinate and abscissa axes are graduated to the same scale, a straight line 10 with a 45° inclination indicates that the real time TR agrees with the display time TD in an accurate timepiece. When the accurate timepiece receives an internal signal warning that the battery voltage is reduced and that the capacity of the battery is approaching exhaustion, a battery life indication begins to be displayed on the indicator 6 by motion of the hands as indicated starting from point 11 in FIG. 2. The quick advance circuit 8, motor 4 and gear train 5 in the timepiece having two hands are designed so that the minute hand is driven normally by inputting an output pulse once in ten seconds from the divider network 2. During the period I (FIG. 2), the minute hand is normally driven by applying a signal once in every ten seconds. But when the battery voltage has been detected as being lower than normal, within defined limits, and starting at operation point 11 (FIG. 2), twelve pulses are input at the rate of twice a second. It should be understood that twelve pulses and the rate of twice a second are chosen for the sake of example in illustrating this invention and other numbers and rates may also be used with properly designed associated circuits. The display 6 of the timepiece, i.e., the minute hand, advances ten seconds, that is one-sixth of a minute distance on the dial in one pulse. Accordingly, inputting of twelve pulses causes the timepiece to display a time which is two minutes fast ($12\times 10$ seconds$=120$ seconds). That is, in the period II in FIG. 2, two pulses are input every second so that the minute hand is moved for 6 seconds after which the time 12 appears on the display indicator 6. Note that the time displayed is in advance of the real time. These accelerating pulses are applied to the driver 3, motor 4, gear train 5 and indicator 6 by means of the circuit 8 for quickly advancing the minute hand (FIG. 1). The actual circuit is described in detail hereinafter in conjunction with FIGS. 3 and 4. When the time 12 is displayed after the rapid advance of the minute hand, no further signal from the divider network 2 is input to the driver 3 until after a 120 seconds have elapsed from the point 11 which is the point where the quick pulsing of the minute hand began. This is indicated by the horizontal line connecting points 12 and 13 in FIG. 2. Accordingly, the period III and the period II together equal 120 seconds of elapsed time. If the user reads the timepiece during the time between the displayed time at point 12 and the displayed time at point 13, he reads a time with a maximum error of 114 seconds (120 minus 6) with respect to the real time. When the real time TR again agrees with the displayed time, i.e., point 13 on the line 10 (FIG. 2), the minute hand is again quickly advanced for 6 seconds by the pulses for quickly advancing the minute hand and the hand displays the time at point 14. That is, the displayed time is again "fast" by approximately 2 minutes. The pattern repeats as described above, when the battery voltage is low, and the minute hand remains at rest for a time indicated in FIG. 2 between the point 14 and the point 15. The point 15 is on the line 10 which indicates that the timepiece has again returned to an accurate setting where the indicated time represents the real time.

Thus the user, who is accustomed to an accurate timepiece, will in time notice that his timepiece is inaccurate by as much as two minutes, and that the minute hand is not in motion for periods of approximately two minutes. The user may also notice that the minute hand is advancing quite rapidly in comparison with its normal rate. The user may still be unaware that the battery voltage is diminishing and that a new battery will be needed in the relatively near future. Or the user may be uncertain whether the timepiece is merely operating fast, or is soon to be in need of a new battery. The means for surely confirming the state of the battery is described hereinafter in conjunction with FIG. 2. When the user finds his timepiece is in the condition where the time indicator needs to be corrected, that is he is aware that the timepiece is fast, the user uses the external operation member 60 to adjust the position of the hands. The hands are reset with a winding stem or a correction button, or the like, which serves as the external member indicated as 60 in FIG. 1. However, as explained more fully hereinafter, pulling out the winding stem also resets the circuits of this invention. After the stem is pulled out, the hands are set in the conventional manner by rotating the winding stem. Then the winding stem is pushed in, after which the output for accelerated hand motion is applied just 10 seconds later. This is a general description of the reset method. In the circuits shown in FIG. 3 a D-type flip-flop 36 and a reset switch 46 are used in this reset method as described hereinafter.

In FIG. 2 after detection of a reduced battery voltage, the minute hand repeats the periodic action of quick moving the hands and then stopping the hands. At that time, when the winding stem is pulled out in order to set the hands, a reset switch which is interlocked with the winding stem is drawn up to contact the ⊕ terminal of the supply voltage. If the minute hand is put back by two minutes using the winding stem for the purpose of hand-setting, the real time 17 is displayed if the adjustment commences at the point 16' of FIG. 2. When the winding stem is then pushed to its original position, simultaneously the reset switch 46 is released from the reset state. At that moment, a signal for advancing the minute hand at a greater speed than the normal speed is applied. Then the displayed time rapidly advances to 18 in FIG. 2. Accordingly, as the rapid advance of the minute hand at a greater speed can be easily seen by the user by pushing the winding stem in after having pulled it out and adjusted the time, it is surely confirmed that the battery is approaching exhaustion. In other words, action of the minute hand in immediately proceeding at an accelerated pace to a fast position just after the user has reset the time from a fast position, will indicate to the user that the watch will soon be in need of a new battery and the watch is not merely running fast or malfunctioning. Thus the battery life is easily checked, especially in the twohand watch such as a ladies' watch or a dress watch in which a battery hatch is not provided so as not to impair the aesthetic design of the watch. Thus the need to open the battery case, which may cause injury to the case or allow the entry of dirt or dust, merely for the purpose of checking the battery voltage, can be avoided. The means provided in this invention are an effective and simple way for checking the supply voltage. Although a winding stem was described above with respect to the reset switch, it should be understood that a button, or the like, which acts independently from the winding stem for the purpose of setting the hands, may also be used. Operation of the button is mechanically interlocked with the reset strcture.

The actual circuit according to this invention and the timing chart of FIG. 2 is now described. The circuit of FIG. 3 is comprised of the quartz crystal oscillator 20, a divider network consisting of stages 21, 22, 23, 24, 41. The divider circuits consist of well-known flip-flops (FF). The circuit of FIG. 3 is also comprised of D-type flip-flops 26, 36 with reset function, D-type flip-flop 42 with set function, the D-type flip-flop 32, and NAND gate 29 for detecting the battery voltage. AND gates 25, 27 are for for selecting the detecting cycle, whose outputs are fed to the OR gate 28. The input to the gate 25 from the flip-flop 32 is inverted. The signal for driving the minute hand at a greater speed for a fixed time period is received by AND gates 43, 44, 45 and gates 33, 34, 35 operate in the normal condition of battery voltage and also at the time when a lower battery voltage is detected indicating a near exhaustion of the battery life. Gate 43 has inverted inputs and the input to gate 34 from flip-flop 32 is inverted. The driving wave form is shaped in the D-type flip-flop 36 whose output is fed to the input of AND gates 37, 38 having inverters 39, 40 respectively for applying a relatively large current for driving the motor. The aforementioned reset switch 46 is constructed to actuate the reset function when the ⊕ power supply is in the high state. The input to gate 37 from the recess switch 46 is an inverted input. The input from the flip-flop 36 to gate 37 is an inverted input, and the input to gate 38 from OR gate 35 is an inverted input.

The quartz crystal oscillator 20 oscillates at a frequency of 32 KHz. Using generally known flip-flop circuits, the divider stage 21 outputs a signal of 128 Hz having a period of 7.8 milliseconds and a second frequency output of 4 Hz. The flip-flop 42, 32 and 36 are positive logic elements and the divider stages 21, 22, 23 and 24 are negative logic elements. Waveforms at different locations in the circuit of FIG. 3 are designated by lower case letters and are correspondingly identified in the waveform diagrams of FIG. 4. For example, the output of 128 Hz designated as e from the divider stage 21 (FIG. 3) is the upper waveform also designated by the lower case letter e in FIG. 4. It should be noted that waveform e is a series of square wave pulses. The 4 Hz signal is inputted to divider stage 22 which outputs a 2 Hz signal f by means of internal flip-flops. Divider stage 23 receives the 2 Hz signal as an input and outputs a one-tenth Hz signal which is LOW for 6 seconds and HIGH for 4 seconds. This output signal g is provided by combining well-known flip-flops in the divider stage 23. The one-tenth Hz signal g is reduced to the one-twentieth Hz signal h by passage through the flip-flop 24. Because the output of the D-type flip-flop 32 is LOW when the exhaustion of the battery life is not detected, that is the battery is at normal voltage, this signal of one-twentieth Hz passes through the AND gate 34 and signals q and r from gates 37 and 38 respectively are generated with a pulse width of 7.8 milliseconds as a result of the phase difference of the 128 Hz signal e applied to the D-type flip-flop 36 having a reset terminal. The current $S_1$ flows into the coil 50 as a reversing signal and the electric fluid generated in the coil core 51 and the stator 52 drives the stepping motor serving as an electromechanical converter for rotating the permanent magnet 53. In the timepiece according to this invention, the minute hand normally moves once every 10 seconds because the signal of one-tenth Hz is applied normally.

Figure 4:
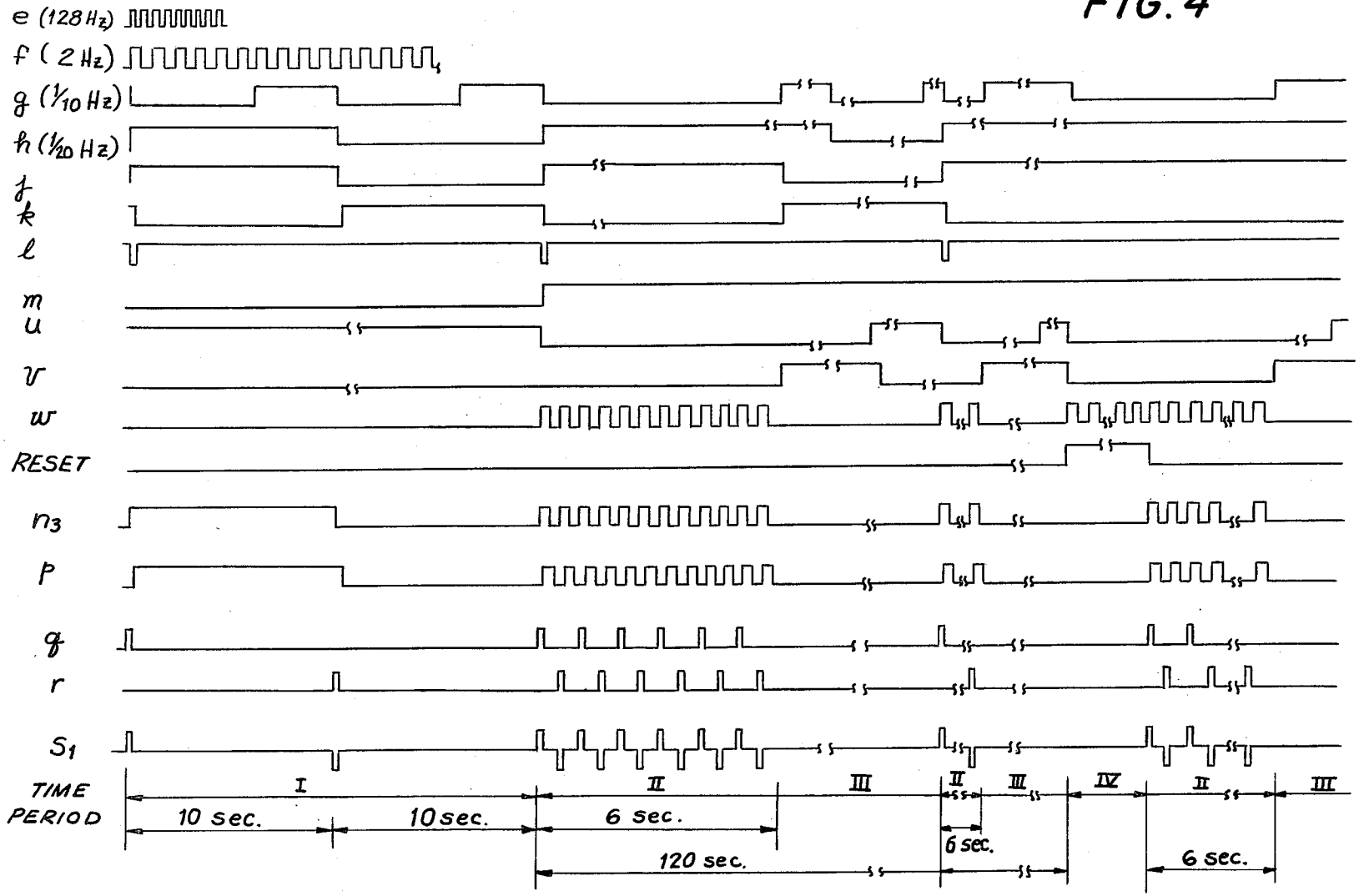
FIG. 4 is the waveform diagram for the circuit of FIG. 3.

The battery voltage is dropped across the P-MOS transistor 30 of the battery voltage detection circuit which conducts only for 7.8 milliseconds by the battery voltage because the gate of the P-MOS transistor 30 becomes LOW for 7.8 milliseconds at intervals of 20 seconds. That is to say, if the battery voltage is higher than the set level of the battery voltage detecting circuit, the P-MOS transistor 30 conducts only for 7.8 milliseconds, and the output of the inverter 49 is HIGH during that period, and the output signal of delayed flip-flop 32 is LOW. The set voltage level which determines whether or not the transistor 30 will conduct upon a negative signal at its gate depends on the setting of the variable resistor 31 in series across the battery with the transistor 30. On the other hand, when the battery voltage is lower than the set level, the P-MOS transistor 30 cannot conduct electrically even if the gate voltage is LOW. Therefore, the output of the inverter 49 maintains a LOW condition and the output m of flip-flop 32 becomes HIGH. When the timepiece is operating normally, the value of battery voltage is detected at intervals of 20 seconds which is the output of the flip-flop 24. When the battery voltage is reduced, the state of reduced battery voltage is indicated by inputting the output of the divider stage 41 relying on the fact that the output of the divider stage 41 is applied at intervals of 120 seconds at the time of voltage reduction. The twenty-second signal from flip-flop 24 is divided by 6 by the well-known flip-flops in divider stage 41 and a signal 120 seconds in duration is outputted from the divider stage 41. The ten-second signal g from divider stage 23, which is LOW for 6 seconds and HIGH for 4 seconds as shown in FIG. 4, is applied as a clock pulse into the D-type flip-flop 42. The output v of the flip-flop 42 is LOW only for 6 seconds. This output v and the output of the divider circuit 41 perform the function of a logical AND. When the output at the AND gate 43 and the 2 Hz signal f from the divider stage 22 are input to the AND gate 44, the output w from the AND gate 45 is 12 pulses over a period of 6 seconds. These signals pass through the AND gate 33 and the OR gate 35 when the output m of flip-flop 32 is high. The signal then passes through the flip-flop 36, AND gates 37 and 38, which constitute the driving waveform shaping circuit, and then the signal passes through the inverters 39, 40, and finally drive the motor at a greater speed than the usual speed over a period of 6 seconds. The driving pulses as stated above occur twice per second during that six-second period. If the reset switch 46 is put into the high condition by operation of the winding stem, the D-type flip-flops are regulated and an output signal is generated for 10 seconds after releasing the reset switch.

FIG. 4 is a waveform diagram. Concerning the periods I, II and III, these periods represent the same periods having identical identification in FIG. 2. The operational events occuring during these time periods is seen from the output signal $S_1$ in FIG. 4. It should be noted in FIG. 3 that $S_1$ indicates the current through the motor coil 50. I is the period when the timepiece is worn and operating in a normal condition. II is the condition in which the quick advancing pulses are applied to the motor 4 of the timepiece when a low battery voltage is detected. III is the condition in which the hands are not driven at all because the output signals to the motor are stopped. Then periods II and III repeat. IV is the condition in which the reset signal is HIGH. The period II after IV is the condition of quick advancing pulses applied immediately after the reset switch is released from the time resetting state. In FIG. 4 the output v of the settable D-type flip-flop 42 is HIGH when the reset signal is HIGH. The signal v applies the quick advancing output pulses for 6 seconds in the period when the clock signal g is LOW.

Because of this invention, the exhaustion of the battery life as indicated by low battery voltage of the two-hand timepiece can be easily detected. This is done by operation of the external operating member such as the winding stem or a reset operating button. The user of the watch can detect the battery's condition just as easily as can be done by a watchmaker.

Figure 5A:
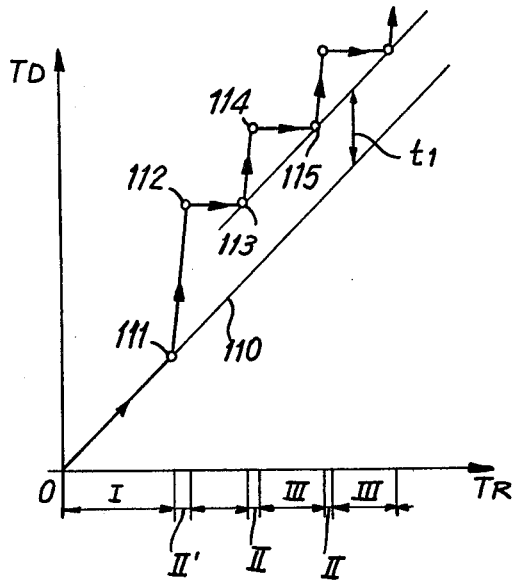
FIGS. 5*a* through 5*e* are charts similar to FIG. 2 showing alternative movements of the minute hand.
Figure 5B:
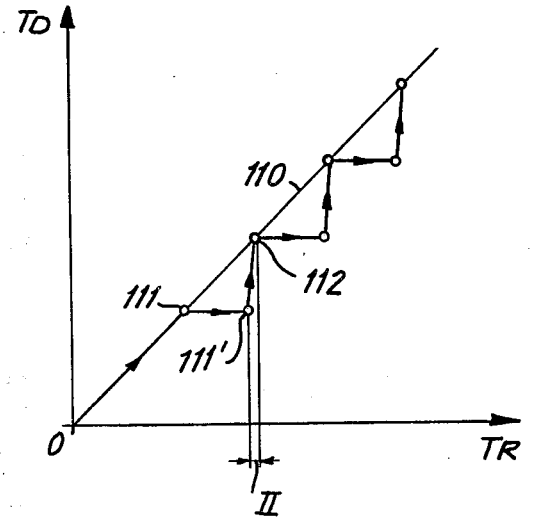
Figure 5C:
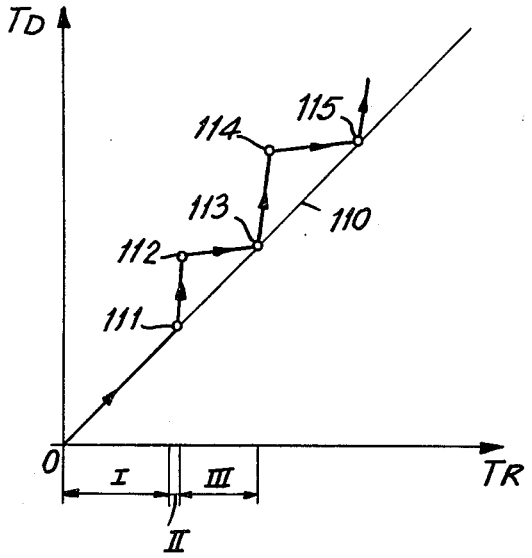

FIG. 5*c* shows an alternative method for detecting the condition of the battery in the timepiece. During the period I of normal operation the timepiece reaches the point 111. If the battery voltage is low as detected by the electronic circuits, then the hands are moved during period II at an accelerated rate to the point 112. During the period III of FIG. 5*c*, the hands move at a slower than normal pace but they are not at a standstill as in FIG. 2.

In the above descriptions, the time period during which the hands display an advanced time in relation to the true time, is put at 120 seconds. The value of 120 seconds is selected merely as an example and this invention is not limited to this particular method. The time period for the advanced hand settings can be for example 180 seconds, 5 minutes, or 10 minutes. There are many advantages to having periodic cycles of rapid advance followed by retarded advance, followed by rapid advance etc. etc., as described above to indicate that the battery voltage is diminishing, as compared to a timepiece which indicates diminished battery voltage by always advancing the minute hand by a fixed amount of time and leaving it in this fast condition permanently. For example, if the watch is permanently set fast by a detection circuit by an amount, for example, five minutes or more, this is a great inconvenience to the user who may not be aware that his timepiece is fast. If using the methods of this invention as described above, the time is to be in an advanced state for a predetermined time selected in the range between 2 minutes and 10 minutes, the maximum time difference between the real time and the display time equals the above selected time difference. However, because after the rapid advance, the timepiece is in the process of returning to real time, the error in time which the user would read will lie between the maximum and the correct time. Thus, in all probability the time difference which the user sees will be less than in the timepiece which remains constantly fast. Such time differences which are repeatedly returning to the true time do not adversely influence the normal use of the watch before the battery is replaced.

Also in the method of this invention the user becomes aware of the irregular movement of the timepiece hands because sometimes the timepiece is fast and sometimes it is accurate. Such irregular movement of the minute hand is very noticeable. On the other hand, if a watch is set to be constantly fast as an indication of battery exhaustion, the user may never become aware of the diminution of voltage level of the battery. Even when the user is aware that his watch is fast, he thinks that he did not correctly adjust the time, or he thinks that his watch is out of order.

As described in conjunction with FIG. 2, twelve pulses are applied as quick advancing signals in order to quickly advance the minute hand in the period II. This takes six seconds to apply the twelve pulses, so it is easy to see the irregular movement of the minute hand. Furthermore, as the minute hand is quickly advanced every two minutes, there are many opportunities to know that the exhaustion point of the battery is approaching. Thus such a watch is much more advantageous than the watch which has only one change to advance the minute hand by a fixed amount of time to indicate a poor condition of the battery. It is desirable in practical applications to set the repetitive cycle at 2 to 10 minutes. The example described above used a two-minute cycle. The most suitable cycle is easily set by adjusting the circuits and is selected to meet the characteristics of the watch movement.

FIG. 5*a* shows an alternative embodiment of the method of this invention. In this embodiment, after it has been detected that the battery voltage is diminished, the watch is advanced by a fixed time $t_1$ in addition to the amount of time which it is advanced in the period II of FIG. 2. The period II′ between points 111 and 112 of FIG. 5*a* is longer than the period II between the points 11 and 12 of FIG. 2. Thus the timepiece of the embodiment represented by FIG. 5*a* will always be fast as indicated by the minute hand by a time at least equal to $t_1$ and in addition will move with the erratic motions as described for the embodiment associated with FIG. 2.

In the alternative embodiment represented in FIG. 5*b*, the method of this invention is basically inverted from that associated with FIGS. 2 and 5*a*. More particularly, when it has been detected that the battery potential is diminishing, the timepiece is allowed to run slow by stopping the motion of the minute hand for a period represented by the points on FIG. 5*b* from 111 to 111′. Then the timepiece minute hand is quickly advanced during the period between the points 111′ and 112 on FIG. 5*b*. At point 112 the timepiece is again accurate. However the retard/advance cycles of operation are repeated periodically as shown in FIG. 5*b*. The magnitude of time which is to be lost and the time which is required for quick advance and return to real time are determined in accordance with the characteristics of the timepiece and its movement.

In FIGS. 2 and 5*a*, the minute hand stops during the time period represented by the symbol III. However, the minute hand need not stop completely. As shown in FIG. 5*c*, during the period between the points 112 and 113, the minute hand is advanced by a pulse for advancing at a speed slower than the normal speed.

Figure 5D:
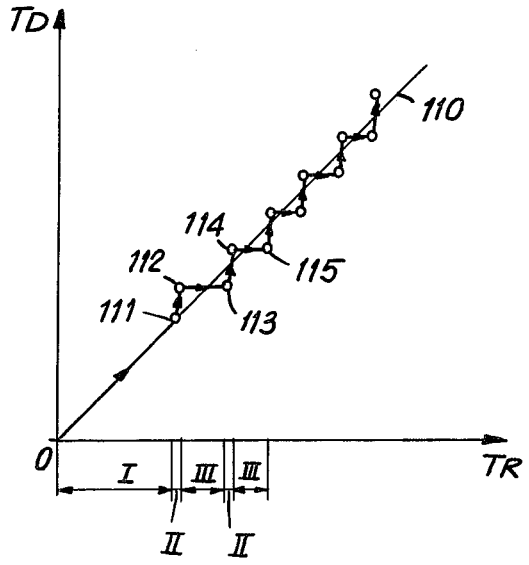
Figure 5E:
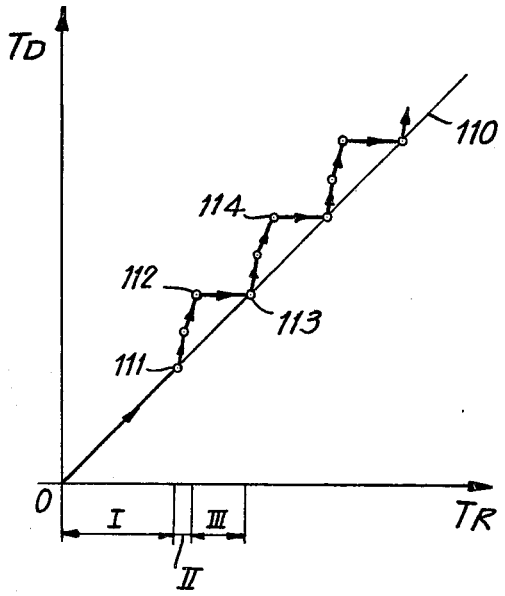

Furthermore, in an embodiment as shown in FIG. 5*d*, the display time is first made fast by a small amount and then the display time TD is made slow with respect to the real time TR. Thus the timepiece is never far from the real time but the rapid movement of the minute hand, for example between points 113 and 114, are readily noticeable to the user as an indication that the battery voltage is diminished. And in another alternative embodiment, the minute hand may be advanced in a way that the time taken to advance the minute hand is divided into several rates. For instance, 6 pulses are applied evenly in three seconds and then each of the remaining six pulses is applied at the rate of once a second. The total time for quick advance is then 9 seconds rather than six seconds as in the previously described embodiments. This gives the user more opportunity to notice that the hands are moving erratically to indicate that the battery voltage is diminished. FIG. 5*e* shows this embodiment. Note that the line of advancement, for example between points 111 and 112 has two slopes, a more rapid slope at the outset than at the termination on point 112.

All of these methods are practical and effective because only a few minutes of time are required to determine that exhaustion of the battery life is approaching.

Figure 6A:
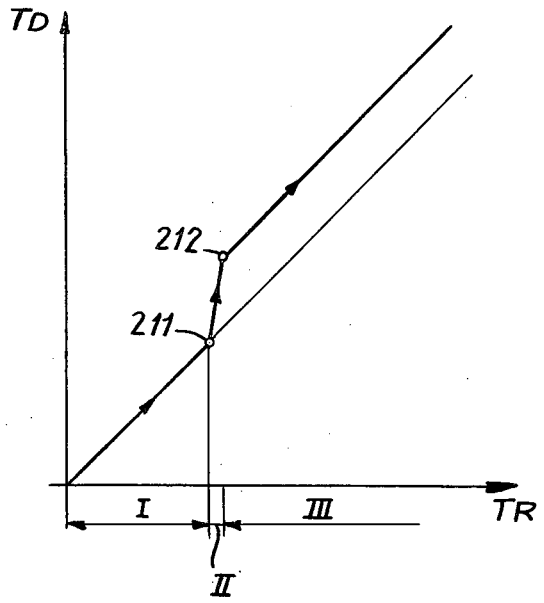
FIGS. 6*a*, 6*b* and 6*c* are charts similar to FIG. 2 showing further alternative movements of the minute hand.
Figure 6B:
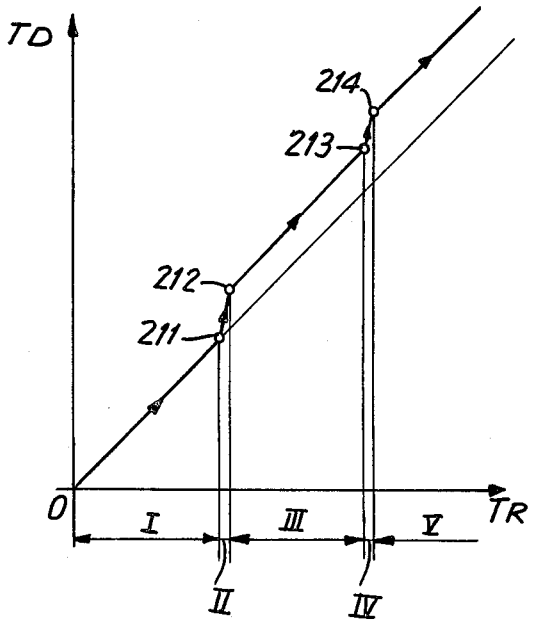
Figure 6C:
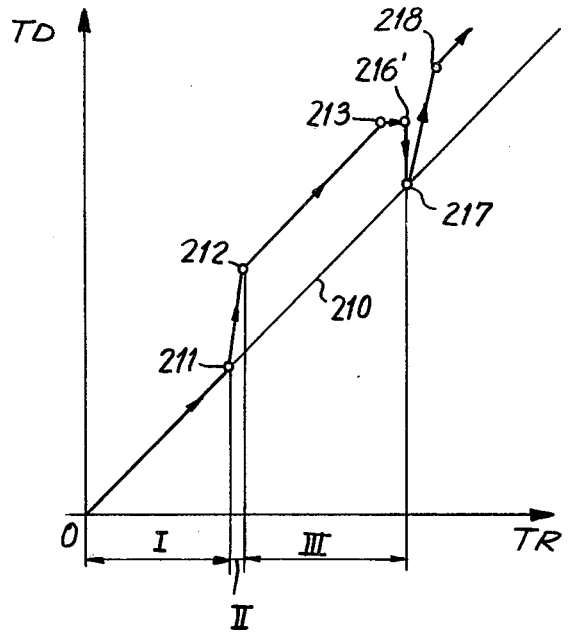
Figure 9:
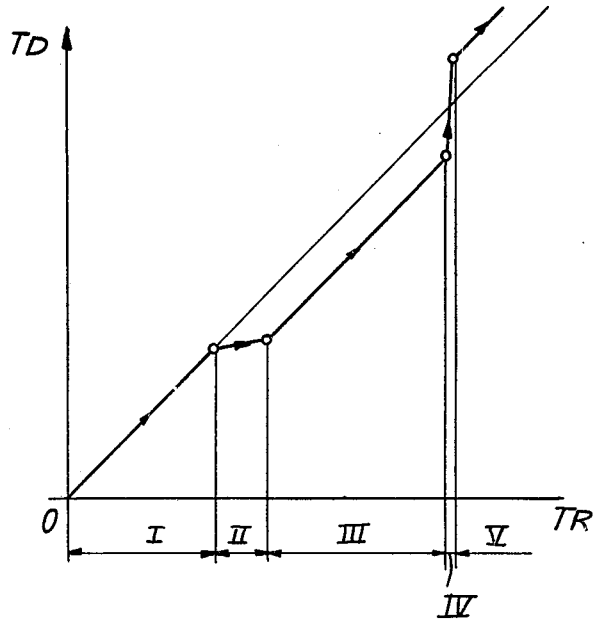
FIG. 9 is a chart of another alternative movement of the minute hand.
Figure 7:
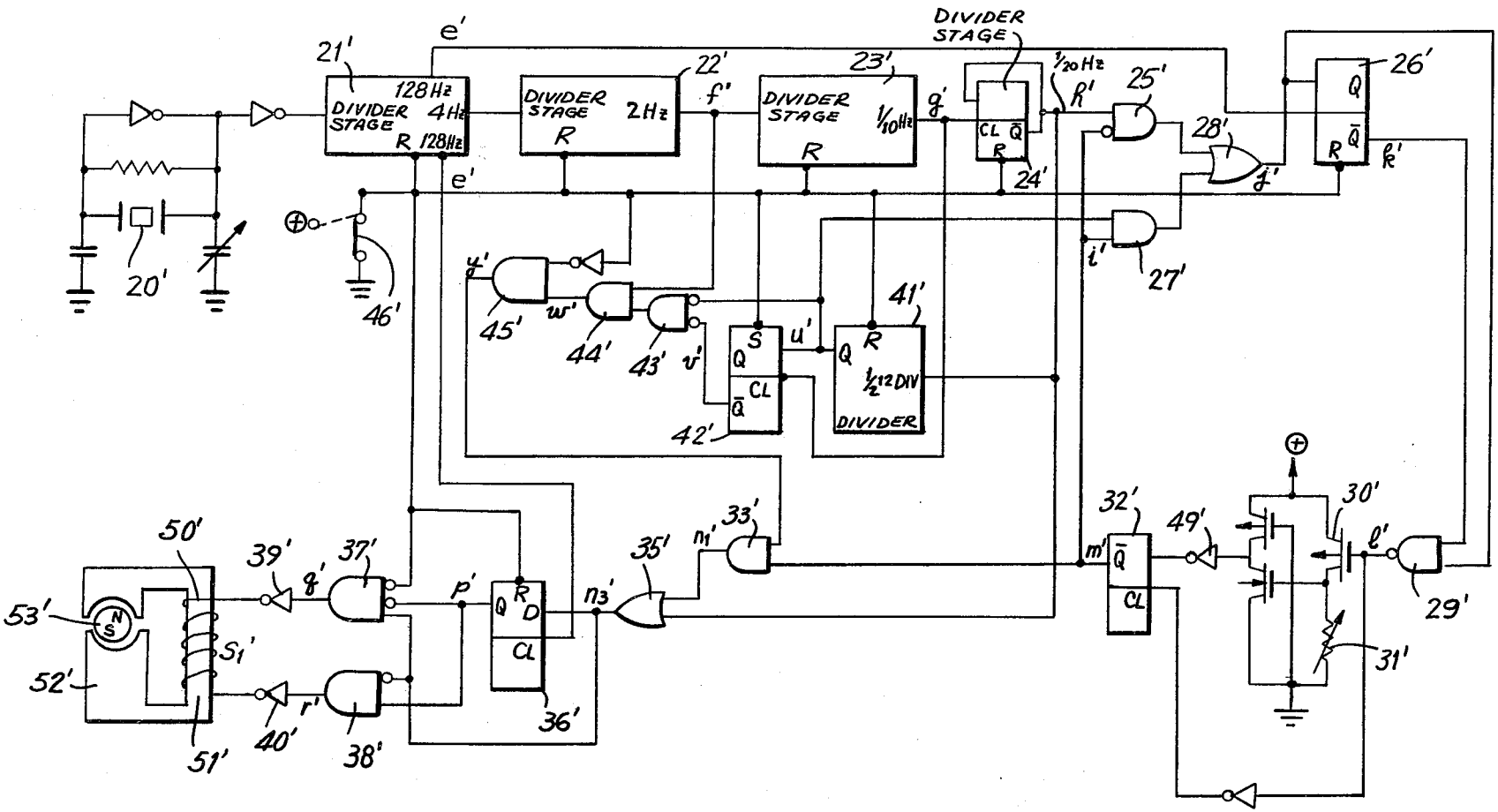
FIG. 7 is the electrical circuit diagram for the timepiece of FIGS. 6*b* and 6*c*.

In FIGS. 6*a* another alternative embodiment is shown wherein when a low battery voltage is detected, the minute hand is advanced at a rapid rate as indicated in FIG. 6*a* between the points 211 and 212. Thereafter, the timepiece is allowed to continue to run at a fast setting in order to draw the attention of the user to a watch which now runs fast but had previously been highly accurate. Because of the reset switch 46, as described in association with FIG. 2, the hands will advance to the fast condition as often as the hands are reset by the user. Thus the user becomes aware that the battery voltage is diminished. It should also be realized, that the timepiece in another alternative embodiment can run continuously slow until reset, when it will again fall back into a slow condition. This technique is most suitable for dress watches and ladies' watches which have only the hour and minute hands. In such quartz crystal watches, it is easy to obtain a monthly accuracy of ten seconds. Such a small difference in the position of the minute hand is hard to read in normal operation because the displayed time and the real time cannot be distinguished by the minute hand. However, by the method of this invention, a time difference far in excess of the ten seconds noted above is induced and thereby the user becomes aware of the exhaustion of the battery life. An induced time difference between displayed time and real time of from several minutes to ten minutes is allowable in practical usage because in the two-handed timepiece there is usually no scale indicating each minute division of the dial. These embodiments can be readily realized by means of circuitry without using any special part such as the light emitting diode or liquid crystal. FIGS. 3 and 4 illustrate such circuits. FIG. 6*b* illustrates an alternative embodiment wherein the timepiece is made to advance, then operate at normal rate, and then advance again, and then operate at a normal rate, etc. When the battery voltage is detected as being in a diminished state, the first advance of the minute hand is made as indicated between points 211 and 212 of FIG. 6*b*. Then the timepiece continues in a fast state but at a normal rate between points 212 and 213. If the battery has not been changed then between the points 213 and 214 the hands are again moved at an accelerated rate whereby the timepiece is made faster. With this method the user is aware of the impending termination of the battery life because the advance or delay of the timepiece becomes larger gradually. The time between points 212 and 213 can be in the order of 24 or 48 hours. FIG. 6*c* illustrates how a watch, which has been accelerated to a fast state and is then continued in normal operation, can then be reset by use of the winding stem or a correction button externally mounted on the timepiece. The process of resetting the hands is indicated in FIG. 6*c* between the points 216′ and 217. This is done electromechanically by operation of the winding or correction button as stated above. However, as seen in the circuit of FIG. 7, a D-type flip-flop 36′ and a reset switch 46′ are actuated when the winding stem is actuated. Therefore if the battery voltage is low as soon as the user has completed his manual adjustment of the hands, the minute hand will again advance rapidly to indicate a fast condition of the watch. Thereby it is intended that the user will be informed that the battery voltage is in fact diminishing. These resetting steps are similar to the action represented by the points 16′ to 17 in FIG. 2. With respect to FIG. 2, the minute hand repeats the action of quick moving and that of stopping after detection of a lowered battery voltage. At that time when the winding stem is pulled from its normal state in order to set the minute hand, the reset switch 46 which is interlocked with the winding stem is drawn up to the positive terminal of the supply voltage. The minute hand is put back so that the real time 17 is displayed. Then, the winding stem is returned to its initial condition, and simultaneously the reset switch 46 is released from the reset state. At that moment, the signal for advancing the minute hand at a greater speed than the normal speed is again applied and the displayed time is advanced to a point 18 on FIG. 2 which corresponds to point 218 on FIG. 6*c*. Accordingly, as the state of advance of the minute hand at a greater speed can be seen by pushing the winding stem after pulling it out, it is reliably confirmed that the battery voltage is diminished. FIG. 9 illustrates still another alternative embodiment of this invention wherein, when a low battery voltage is detected, the timepiece advances at a slower than normal rate so that the minute hand indicates a late time. This is indicated in FIG. 9 by the region II. Then follows a period of normal timekeeping rate, however, the timepiece continues to indicate a slow time. This normal timekeeping rate period is indicated as III in FIG. 9. This is followed by an extended period of accelerated advancement of the minute hand whereby the minute hand moves from a condition of indicated lateness to a fast condition. This change from slow to fast indications occurs over a very short period of time indicated by IV in FIG. 9. Then normal timekeeping, although showing a fast display is continued. The reversal from slow to fast conditions of the display soon become apparent to the user who is then on notice that the battery is approaching exhaustion.

Figure 8:
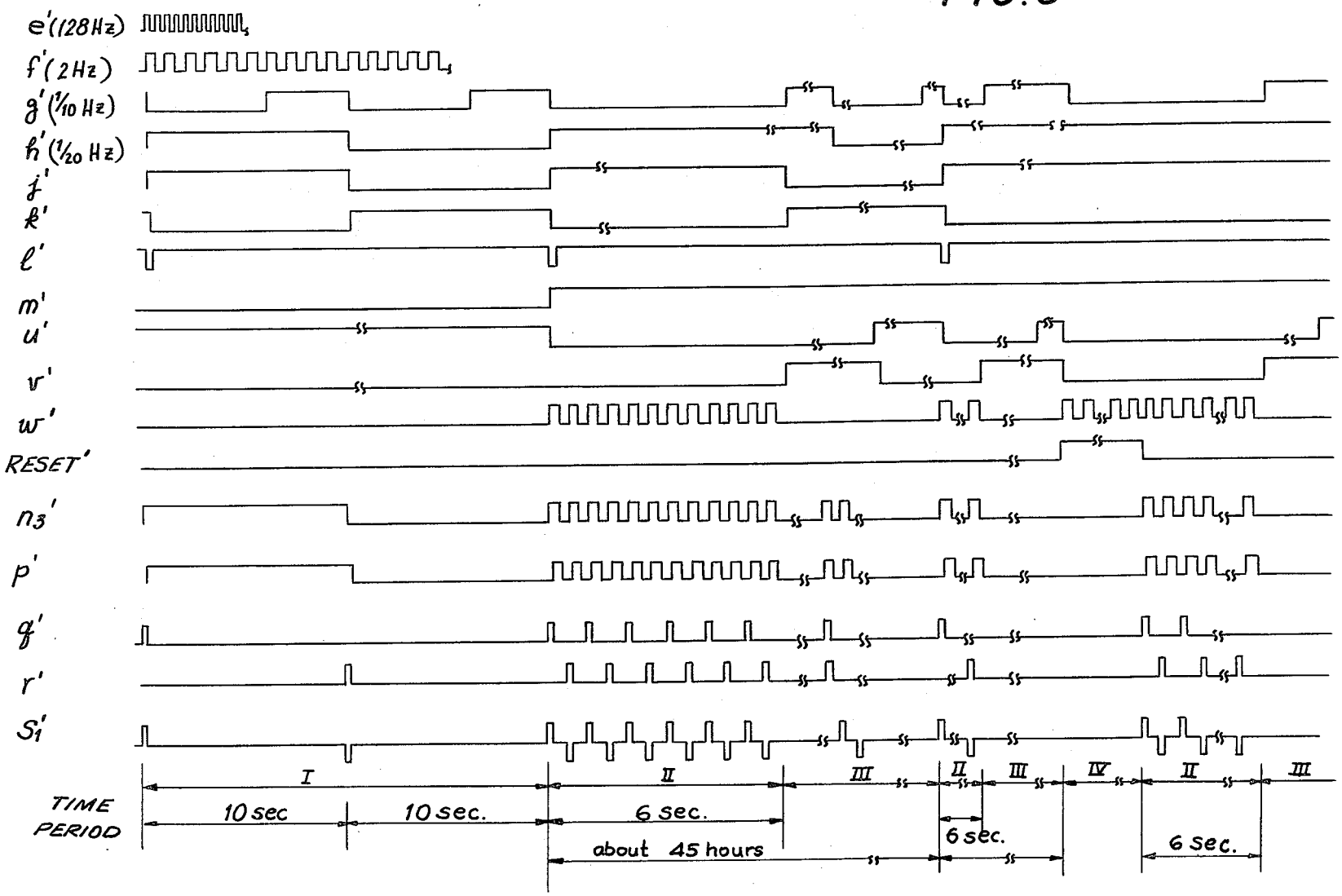
FIG. 8 is the waveform diagram for the circuit of FIG. 7.

The circuit and wave form diagram according to this invention are shown in FIGS. 7 and 8 mainly taking the examples of FIGS. 6*b* and 6*c*. It should be noted that the circuits of FIGS. 3 and 7 and FIGS. 4 and 8 are substantially similar. For this reason similar reference numbers and wave form symbols are used in these Figures, with a distinguishing prime marking (′) being used in FIGS. 7 and 8. Because of their close similarity in structure and performance a full description of FIGS. 7 and 8 is omitted here. However, the circuits differ in that divider 41 of FIG. 3 is a 1/6 divider stage and the divider 41′ of FIG. 7 is a $\frac{1}{2}^{12}$ divider stage. Also an equivalent to gate 34 has been omitted from FIG. 7. The output (20 seconds) of stage 24′ is inputted directly into OR gate 35′. As a result of these circuit changes the timing of the system is changed such that the sum of periods II and III, which is 120 seconds (FIGS. 3, 4) as described above, is extended in the example of FIGS. 7, 8 to about 45 hours.

It should be noted that the element identified by reference numeral 62 of FIG. 1, generally represents the logical networks which control the application and time duration of the driving pulses of different frequencies which are applied to the driver.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intented to cover all of the generic and specific features of the invention herein described and all statements of the scope of the invention which, as a matter of language, might be said to fall therebetween.

What is claimed is:

1. A method for indicating the diminished output of the power source in an electronic analog timepiece having hands to indicate the time, and driving means to advance said hands, comprising the steps of:

(a) detecting the diminished output of the power source;

(b) altering the rate of driving said hands from the normal rate of driving said hands whereby the time indicated by said hands deviates from real time;

(c) driving said hands at said normal rate;

(d) repeating step (b), again altering said rate, whereby said hands further deviate from real time;

(e) continuously repeating steps (c) and (d).

2. The method of claim 1 and further including the step of setting said hands when deviant to the real time, said setting being performed at any step in said methods and repeating, beginning at step (a), upon completion of said setting.

3. The method of claim 1 or 2 wherein said steps (b) and (c) are completed in a fixed period of time.

4. The method of claim 1 or 2, wherein said deviation is caused by driving said hands at a rate above said normal rate.

5. A method for indicating the diminished output of the power source in an electronic analog timepiece having hands to indicate the time, and driving means to advance said hands, comprising the steps of:

(a) detecting the diminished output of the power source;

(b) altering the rate of driving said hands from the normal rate of driving said hands whereby the time indicated by said hands deviates from real time;

(c) driving said hands at normal rate;

(d) setting said hands when deviant to the real time;

(e) repeating steps (a), (b), (c).

6. An electronic analog timepiece including:

an electric power source;

a high frequency oscillator operating from said power source and outputting a frequency signal;

a divider network dividing down the output frequency signal of said oscillator providing a low frequency signal output for normal timekeeping;

means for providing an analog indicator of time on said timepiece;

means for driving said analog means in response to said output signals from said divider network, the rate of driving of said analog means being proportionate to the frequency of said output signal from said divider network;

control means for operating of said analog means at a driving rate other than the driving rate for normal timekeeping, said control means including means to detect the voltage of said power source and being adapted, upon detection of a diminished voltage, to direct a frequency signal other than said first rate for normal timekeeping from said divider network to said means for driving said analog means to alter the driving rate of said analog means whereby said analog means deviate from indicating real time, said control means being further adapted to return said timepiece to operation at said rate for normal timekeeping for a fixed period of time, said control means then alternating operation of said timepiece between said altered rate and said rate for normal timekeeping whereby the time indicated by said analog means becomes increasingly deviant.

7. The electronic analog timepiece of claim 6 and further including manually operated external means for setting said analog means to indicate time; and switch interlock means for interrupting and re-initiating said frequency signals from said divider network to said analog means, said interlock means interrupting said altered rate driving when said external means are actuated to set said analog means, said interlock means re-initiating said altered rate cycles upon completion of said setting by said external member and continued detection of a diminished voltage by said voltage detecting means.

8. The electronic analog timepiece of claim 7, wherein said re-initiating results from resetting of said control means by said external means.

9. The electronic analog timepiece of claim 6, wherein said analog means are hands.

10. An electronic analog timepiece as claimed in claim 6, wherein said signals for driving said analog means for said normal timekeeping are continuously inputted to said means for driving.

11. An electronic analog timepiece as claimed in claim 10, wherein said driving rate is altered by superposition of signals at a higher rate on said rate for normal timekeeping signals.

12. An electronic analog timepiece as claimed in claim 11, wherein said higher rate signals are superposed for a fixed period of time, cessation of said higher rate signals returning said timepiece to the normal rate of timekeeping.

13. An electronic analog timepiece as claimed in claim 6 or 12, wherein said control means includes a supplemental divider network outputting a lower frequency signal than said low frequency signal output for normal timekeeping, the period of said lower frequency signal determining the repetition rate of said altered rate of driving.

14. An electronic analog timepiece as claimed in claim 13, wherein operation of said external means resets said divider network for normal timekeeping and said supplemental divider network, whereby said altered rate is superposed when operation of said external member is terminated.

15. The electronic analog timepiece of claim 7, wherein said switch interlock means interrupts said frequency signals by application of a reset signal to stages of said divider network and re-initiates said frequency signals by removal of said reset signal.

16. A method for indicating the diminished output of the power source in an electronic analog timepiece having hands to indicate the time, and driving means to advance said hands comprising the steps of:

(a) detecting the diminished output of said power source;

(b) altering the rate of driving said hands from the normal rate of driving said hands, whereby the time indicated by the said hands deviates from real time and thereafter driving said hands at the normal rate to maintain said deviation;

(c) correcting said hands, said hands being deviated from real time, to indicate the real time by operation of an external member;

(d) repeating step (b) after said time correction is completed, whereby the repeated deviations of said hands from real time alert the user to the diminished power source condition.

* * * * *